US010240603B2

(12) United States Patent
Rockwood et al.

(10) Patent No.: US 10,240,603 B2
(45) Date of Patent: Mar. 26, 2019

(54) COMPRESSOR HAVING EXTERNAL SHELL WITH VIBRATION ISOLATION AND PRESSURE BALANCE

(71) Applicant: TRANE INTERNATIONAL INC., Piscataway, NJ (US)

(72) Inventors: William B. Rockwood, Onalaska, WI (US); Pavak Mehta, La Crescent, MN (US); Dennis M. Beekman, La Crosse, WI (US); Daniel R. Crum, Huntersville, NC (US); Timothy G. Garvin, La Crosse, WI (US); Rodney L. Lakowske, La Crosse, WI (US); Gordon Powell, Jr., Stoddard, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 133 days.

(21) Appl. No.: 14/718,812

(22) Filed: May 21, 2015

(65) Prior Publication Data

US 2015/0337840 A1 Nov. 26, 2015

Related U.S. Application Data

(60) Provisional application No. 62/001,888, filed on May 22, 2014.

(51) Int. Cl.
*F04C 18/16* (2006.01)
*F04C 29/00* (2006.01)
(Continued)

(52) U.S. Cl.
CPC ..... *F04C 29/06* (2013.01); *F04C 18/0215* (2013.01); *F04C 18/0223* (2013.01);
(Continued)

(58) Field of Classification Search
CPC ..... F04C 29/0021; F04C 29/0035; F04C 18/16–18/165; F04C 23/008;
(Continued)

(56) References Cited

U.S. PATENT DOCUMENTS 3,317,121 A 5/1967 De Groat
3,445,059 A 5/1969 Hannibal et al.
(Continued)

FOREIGN PATENT DOCUMENTS

CN 1400391 A 3/2003
CN 101846075 A 9/2010
(Continued)

OTHER PUBLICATIONS

Extended European Search Report, dated Oct. 1, 2015; European Patent Application No. 15169040.1 (6 pages).

*Primary Examiner* — Mark Laurenzi
*Assistant Examiner* — Xiaoting Hu
(74) *Attorney, Agent, or Firm* — Hamre, Schumann, Mueller & Larson, P.C.

(57) ABSTRACT

Methods, systems, and apparatuses are disclosed to isolate operation vibration of a compressor to reduce operational sound. A compressor may include an external shell, and one or more isolators that separate a compression mechanism of a compressor from the external shell. The isolator can help isolate the vibration of the compression mechanism from the external shell. The isolator can also support a weight of the compression mechanism. The external shell can also include one or more internal seals. The internal seals can help separate a low-pressure side (e.g., a suction side) and a high-pressure side (e.g., a discharge side) of the compression mechanism. The compressor may also include a pressure balancing mechanism configured to help reduce a pressure difference between, for example, two ends of the compression mechanism, so as to reduce/eliminate the compression mechanism from physical shift in position due to the pressure difference.

10 Claims, 8 Drawing Sheets

(51) Int. Cl.
*F04C 29/06* (2006.01)
*F04C 18/02* (2006.01)
*F04C 23/00* (2006.01)

(52) U.S. Cl.
CPC ..... *F04C 18/16* (2013.01); *F04C 23/008* (2013.01); *F04C 29/0021* (2013.01); *F04C 29/0035* (2013.01); *F04C 29/0042* (2013.01); *F04C 29/063* (2013.01); *F04C 29/065* (2013.01); *F04C 29/066* (2013.01); *F04C 29/068* (2013.01); *F04C 2240/30* (2013.01); *F04C 2270/12* (2013.01); *F04C 2270/13* (2013.01)

(58) Field of Classification Search
CPC ..... F04C 29/06; F04C 29/063; F04C 29/068; F04C 2270/12; F04C 2270/125; F04C 2270/13; F04C 2270/135; F04C 2240/30; F04C 11/008; F04C 29/066; F04B 39/0033; F04B 39/127; F04B 39/0044; F04B 53/002; F04B 53/003; F04D 29/664; F04D 29/668; F04D 29/40
See application file for complete search history.

(56) References Cited

U.S. PATENT DOCUMENTS 3,448,918 A 6/1969 Cawley
3,462,075 A 8/1969 Dirk et al.
4,174,189 A 11/1979 Elson
4,487,555 A 12/1984 Ohinata et al.
4,544,334 A 10/1985 Ellis
5,183,395 A * 2/1993 Langouet ..... F04C 28/125 417/310
5,281,115 A * 1/1994 Timuska ..... F01C 21/003 418/203
5,354,182 A * 10/1994 Niemiec ..... F01C 21/007 248/638
5,980,222 A 11/1999 Fry
6,050,797 A * 4/2000 Zhong ..... F04C 29/0021 418/203
6,543,741 B1 4/2003 Li et al.
6,786,707 B2 9/2004 Kim
6,966,761 B1 11/2005 Roke et al.
7,592,083 B2 9/2009 Meltser et al.
7,762,798 B2 7/2010 Ogasawara et al.
2002/0146332 A1* 10/2002 Sishtla ..... F04C 18/16 417/366
2003/0021706 A1* 1/2003 Kim ..... F04C 23/008 417/363
2004/0258551 A1* 12/2004 Yoshimura ..... F04C 18/16 418/201.1
2006/0065478 A1* 3/2006 Rockwell ..... F01C 21/10 181/250
2008/0008612 A1* 1/2008 Kim ..... F04C 18/0215 418/55.1
2010/0247366 A1* 9/2010 Kato ..... F01C 21/10 418/201.1
2012/0034114 A1 2/2012 Lee
2012/0237381 A1* 9/2012 Murakami ..... F01C 21/10 418/55.1
2013/0156614 A1 6/2013 Bonifas
2014/0271242 A1* 9/2014 Calhoun ..... F04C 15/0057 417/53
2016/0017885 A1* 1/2016 Al-Hasan ..... F04C 29/0035 417/410.3

FOREIGN PATENT DOCUMENTS

CN 102678549 A 9/2012
CN 204163991 U 2/2015
EP 2500517 9/2012
GB 2032004 4/1980
JP 03096693 4/1991
WO 2012141949 10/2012

* cited by examiner

COMPRESSOR HAVING EXTERNAL SHELL WITH VIBRATION ISOLATION AND PRESSURE BALANCE

FIELD

This disclosure relates to a compressor, such as, for example, a refrigerant compressor in a heating, ventilation, and air-conditioning ("HVAC") system. More specifically, methods, systems, and apparatuses are described that are directed to reducing/preventing sound radiated by the compressor and vibration transmitted to other parts of the HVAC system, such as, e.g., refrigerant lines.

BACKGROUND

A compressor, such as a refrigerant compressor in an HVAC system, typically radiates sound and transmits vibration during operation. Such sound and vibration can be radiated to the environment and/or transmitted to, e.g., a facility served by the HVAC system via discharge and/or suction lines, causing undesired sound.

SUMMARY

Methods, systems, and apparatuses directed to isolating vibration of a compressor and reducing sound radiated by the compressor are disclosed.

Generally, the compressor may include a compression mechanism and an external shell. The compression mechanism may be enclosed in the external shell, which can help reduce sound radiated by the compression mechanism. In some embodiments, the compression mechanism may be separated from the external shell by one or more isolators. The isolator(s) can be relatively resilient to help reduce vibration transmitted from the compression mechanism to the external shell, reducing operational sound. The isolator(s) can also be rigid enough to help support a weight of the compression mechanism.

In some embodiments, the external shell may be configured to include a first compartment and a second compartment. The first and second compartments may be configured to enclose a low-pressure side or a high-pressure side of the compression mechanism. In some embodiments, the external shell may include a third compartment. The third compartment may enclose a first portion of the compression mechanism, where the first compartment may enclose a second portion of the compression mechanism, and the first portion and the second portion of the compressor may be oppositely located. A pressure in the first compartment and a pressure in the third compartment may be equalized, which may help reduce or eliminate a physical shift in position of the compression mechanism due to a pressure difference inside the external shell. In some embodiments, the pressure in the first compartment and the pressure in the third compartment can be balanced by a pressure balancing line, which may form a fluid communication between the first compartment and the third compartment.

In some embodiments, the low-pressure side may include a suction port of the compression mechanism, and the high-pressure side may include a discharge port of the compression mechanism.

In some embodiments, the external shell may include an outlet, and the outlet and the discharge port can form fluid communication with the first compartment. In some embodiments, the external shell may include an inlet, and the inlet and the suction port can form fluid communication with the second compartment.

In some embodiments, the discharge port can be equipped with a muffler. In some embodiments, the compressor can be a screw compressor, a scroll compressor, or other suitable compressors. In general, the compressor can be a suitable gas (e.g., refrigerant or air) compressor. In some embodiments, the embodiments disclosed herein may also work with a liquid pump.

In some embodiments, a method of reducing operational sound of a compressor may include: enclosing a compression mechanism of the compressor in a shell; partitioning the shell to include a first compartment and a second compartment; positioning a low-pressure side of the compression mechanism in the first compartment and a high-pressure side of the compression mechanism in the second compartment; and isolating the compression mechanism from the shell.

In some embodiments, the method may include partitioning the shell to include a third compartment, where a third portion of the compression mechanism may be positioned in the third compartment, and balancing a pressure in the first compartment and the third compartment when the compression mechanism is in operation.

In some embodiments, the method may include partitioning the shell to include a third compartment, wherein a third portion of the compression mechanism is positioned in the third compartment, and balancing a pressure in the first compartment and the second compartment when the compression mechanism is in operation.

Other features and aspects will become apparent by consideration of the following Detailed Description and accompanying drawings.

BRIEF DESCRIPTION OF THE DRAWINGS

References are made to the accompanying drawings that form a part of this disclosure and which illustrate embodiments in which system and methods described in this specification can be practiced.

Like reference numbers represent like parts throughout.

DETAILED DESCRIPTION

Operational sound of a compressor, such as, for example, a compressor in an HVAC system can be undesirable. Reducing operational sound of the compressor may be desired when the compressor is used, for example, in a relatively quiet environment (e.g., a school, a hospital, etc.). Operational sound can be produced by, for example, operational vibration of a compression mechanism of the compressor.

This disclosure is directed to methods, systems, and apparatuses that can reduce/prevent operational vibration/sound of a compressor from being radiated/transmitted, thereby reducing operational sound of the compressor. In some embodiments, the compressor may include an external shell and one or more vibration isolators that separate a compression mechanism of the compressor from the external shell. The isolator can help isolate the vibration of the compression mechanism from the external shell so that the vibration of the compression mechanism can be prevented from being transmitted to the external shell and/or other components of the HVAC system, e.g., suction/discharge lines, etc. The external shell can help reduce sound radiated by the compression mechanism. In some embodiments, the isolators can be configured to support a weight of the compression mechanism. The external shell can also include one or more internal seals. The internal seals can help separate a low-pressure side (e.g., a suction side) and a high-pressure side (e.g., a discharge side) of the compression mechanism. In some embodiments, the external shell may include a pressure balancing mechanism configured to help reduce a pressure difference between, for example, two ends of the compression mechanism, so as to reduce/eliminate the compression mechanism from a physical shift in position due to the pressure difference between the two ends of the compressor.

Embodiments, as disclosed herein, may generally work with an HVAC system, an air distribution system, a liquid distribution system, or other suitable systems.

References are made to the accompanying drawings that form a part hereof, and in which is shown by way of illustrating embodiments which may be practiced. It is to be understood that the terms used herein are for the purpose of describing the figures and embodiments and should not be regarded as limiting.

Figure 1:
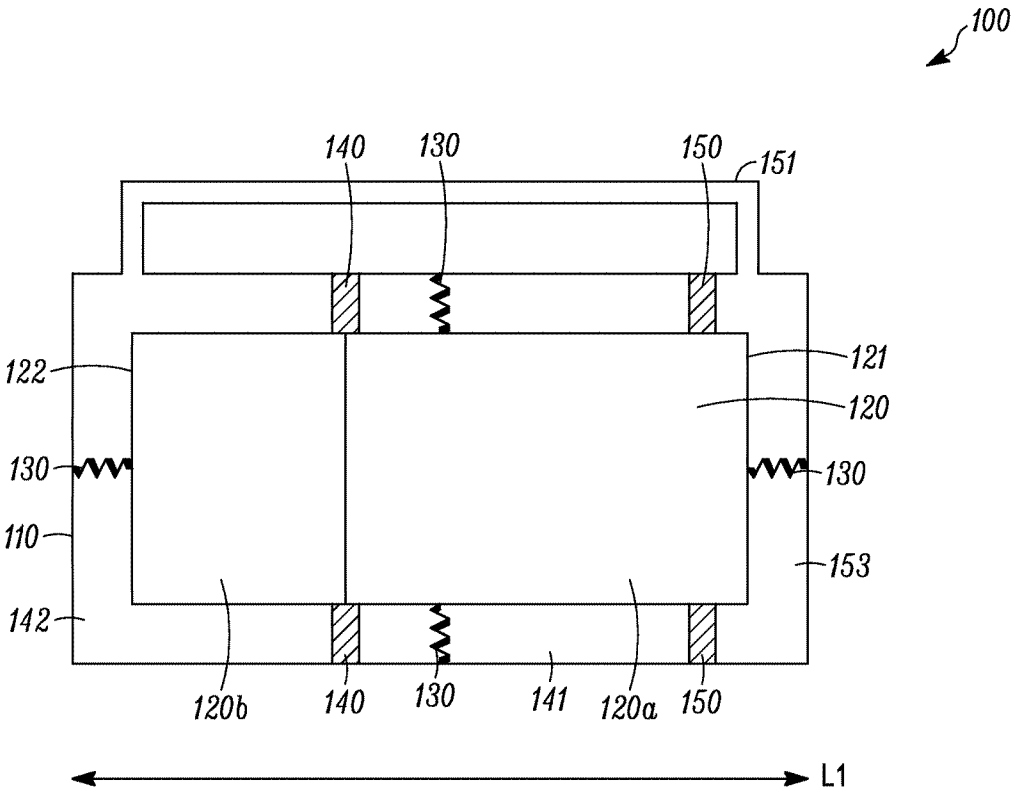
FIG. 1 illustrates a schematic diagram of a compressor that includes features to help reduce sound radiation and vibration transmission from a compression mechanism to an external shell, according to some embodiments.

FIG. 1 illustrates a schematic drawing of a compressor 100. The compressor 100 generally includes an external shell 110 and a compression mechanism 120, where the external shell 110 generally encloses the compression mechanism 120. The compressor 100 is configured to isolate vibration of the compression mechanism 120, so as to reduce vibration of the compression mechanism 120 from being transmitted to the external shell 110, which can help reduce operational sound of the compressor 100. The external shell 110 can generally help reduce sound radiated from the compression mechanism 120. The compression mechanism 120 is generally configured to compress a fluid (e.g., air, gas, refrigerant, etc.) from a relatively low pressure to a relatively high pressure. In an HVAC system, the compression mechanism 120 can include, for example, one or more screws, or scrolls.

The compression mechanism 120 may typically include a first pressure side 120*a*, and a second pressure side 120*b*. In some embodiments, the first pressure side 120*a* may be a low-pressure side, such as a suction side of a compressor in an HVAC system, while the second pressure side 120*b* may be a high-pressure side, such as a discharge side of a compressor in an HVAC system. During operation, the compression mechanism 120 may produce vibration.

The compression mechanism 120 is separated from the external shell 110 by one or more isolators 130. The term "isolator" generally refers to a device, a structure, and/or a material that is configured to separate two components, (e.g., the external shell 110 and the compression mechanism 120), and can generally prevent/reduce vibration transmitted between the two components. In some embodiments, the isolators 130 can be configured to support a weight of the compression mechanism 120.

The isolator 130 can include a resilient member such as but not limited to, for example, a biasing member, which could be, but is not limited to, a metallic spring, a relatively soft material such as, for example, a rubber, a dynamically soft device, or other suitable materials and/or configurations. The isolator 130 can be relatively dynamically soft in relation to attached structures (e.g., the external shell 110). Generally, the isolators 130 may be configured to separate the compression mechanism 120 from the external shell 110 and can be relatively resilient, so that the vibration of the compression mechanism 120 transmitted to the external shell 110 can be reduced or prevented, resulting in reduced radiated sound levels. The isolators 130 can also be relatively rigid so that a weight of the compression mechanism 120 can be supported by the isolators 130 in some embodiments.

The compressor 100 also includes a seal 140 (e.g., a pressure seal, etc.) configured to partition the external shell 110. The seal 140, the external shell 110, and the compression mechanism 120 can help define a first compartment 141 and a second compartment 142 that are separated by the seal 140. The seal 140 is generally configured to prevent fluid communication between the first compartment 141 and the second compartment 142, e.g., when the compressor 100 is in operation. In the illustrated embodiment, the first compartment 141 is in fluid communication with the first pressure side 120*a*, and the second compartment 142 is in fluid communication with the second pressure side 120*b* of the compression mechanism 120. During the operation of the compressor 100, a pressure in the first compartment 141 may be different from a pressure in the second compartment 142. The seal 140 may be configured to withstand the pressure difference between the first compartment 141 and the second compartment 142 and generally provide a seal between the first compartment 141 and the second compartment 142, when for example the compressor is in operation. The separation and seal between the first compartment 141 and the second compartment 142 can allow, for example, an uncompressed fluid to be directed into one of the first or second compartments 141, 142, and the compressed fluid to be discharged from the other of the first or second compartments 141, 142, after being compressed by the compression mechanism 120.

In some embodiments, the seal 140 can be configured to be relatively resilient, so that the seal 140 can be configured to withstand the vibration of the compression mechanism 120 and maintain the seal between the first compartment 141 and the second compartment 142.

In some embodiments, the compressor 100 can include a pressure balancing mechanism, which can include a second seal 150 and a pressure-balancing line 151. The second seal 150, the external shell 110, and the compression mechanism 120 can define a third compartment 153.

The compression mechanism 120 has a first end 121 and a second end 122 in a longitudinal direction L1. As illustrated, the first end 121 of the compression mechanism 120 is contained in the third compartment 153; and the second end 122 of the compression mechanism 120 is contained in the second compartment 142. The pressure-balancing line 151 forms fluid communication between the second compartment 142 and the third compartment 153 to help balance pressure between the second compartment 142 and the third compartment 153. Equalizing the pressure in the second compartment 142 and the third compartment 153 can help prevent or at least reduce a physical shift in position of the compression mechanism 120 in the longitudinal direction L1 due to a pressure difference between the first end 121 and the second end 122.

In the illustrated embodiment of FIG. 1, the seal 140 helps define the first compartment 141 and the second compartment 142, which can have different pressures. The seal 140 can provide a pressure seal between the first compartment 141 and the second compartment 142. The compression mechanism 120 is positioned across the first compartment 141 and the second compartment 142. Without the second seal 150 and the pressure-balancing line 151, one portion of the compression mechanism 120 (e.g., the first end 121 of the compression mechanism) may be under a different pressure than another portion of the compression mechanism 120 (e.g., the second end 122 of the compression mechanism). The pressure difference between the first compartment 141 and the second compartment 142 can cause a physical shift in position of the compression mechanism 120, for example, in the longitudinal direction L1. The pressure-balancing mechanism can help define the third compartment 153 that is at the opposite end of the second compartment 142 relative to the longitudinal direction L1, and contains a portion of the compression mechanism 120 (e.g., the first end 121 of the compression mechanism). By balancing the pressure between the second and third compartments 142, 153, a physical shift in position that may be caused by the pressure difference can be prevented or at least reduced to not having a significant impact. It is to be appreciated that the pressure-balancing mechanism can be optional.

In general, when a pressure on a first portion may be different from a pressure on a second portion of a compression mechanism in operation, the pressure difference can cause a physical shift in position of the compression mechanism in a particular direction. To help prevent such a physical shift in position, a third portion of the compression mechanism can be defined oppositely to the first portion relative to the particular direction. Balancing the pressure on the first portion and the pressure on the third portion can help reduce or eliminate the physical shift in position caused by the pressure difference between the first portion and the second portion.

It is to be appreciated that the compressor 100 in FIG. 1 can be operated in various orientations. FIG. 1 illustrates that the compressor 100 is oriented so that the first pressure side 120*a* and the second pressure side 120*b* are arranged in horizontally in the direction shown. This is exemplary. The compressor can be oriented in other directions. For example, the compressor can be oriented so that the first pressure side 120*a* and the second pressure side 120*b* can be arranged in vertical direction.

Generally, a method of isolating vibration of a compressor may include: providing an external shell configured to generally enclose a compression mechanism; and isolating the compression mechanism from the external shell so that vibration of the compression mechanism can be prevented from being transmitted to the external shell, or the vibration transmitted can be reduced. As illustrated in FIG. 1, the isolation between the compression mechanism 120 and the external shell 110 can be provided by one or more isolators 130. The method can also include partitioning a space of the external shell to include a first compartment and a second compartment so that the first compartment may contain a high-pressure side of the compression mechanism, and the second compartment may contain a low-pressure side of the compression mechanism. In a compressor of an HVAC system, for example, the low-pressure side can be a suction side of the compressor and the high-pressure side can be a discharge side of the compressor. In some embodiments, the method can also include partitioning the space of the external shell to include a third compartment in the external shell so that a portion of the compression mechanism is positioned in the third compartment. The third compartment in some embodiments can be located on an opposite side of the first or second compartment. In some embodiments, the method can include balancing the pressure between the third compartment and the first or second compartment so that a physical shift in position can be reduced or eliminated. As illustrated in FIG. 1, by balancing the pressure between the first and third compartments 141, 153, the physical shift in position in the longitudinal direction L1 of the compression mechanism 120 can be reduced or eliminated.

Figure 2:
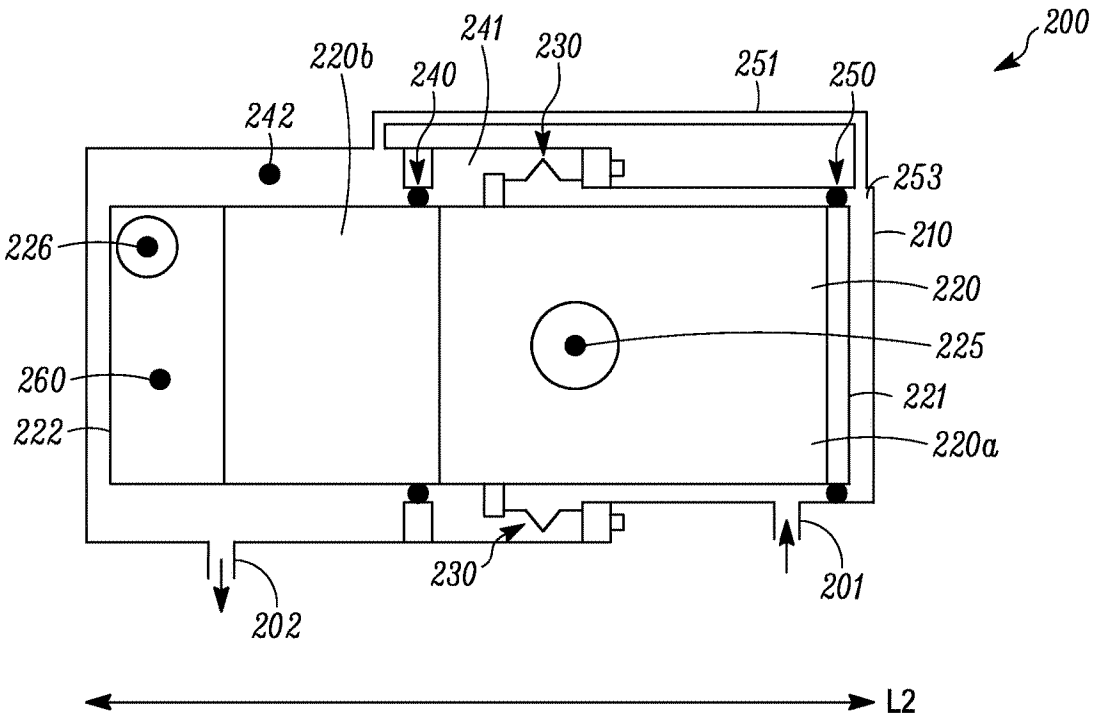
FIG. 2 illustrates a schematic diagram of a screw compressor that includes features to help reduce sound radiation and vibration transmission from a compression mechanism to an external shell, according to some embodiments.
Figure 3:
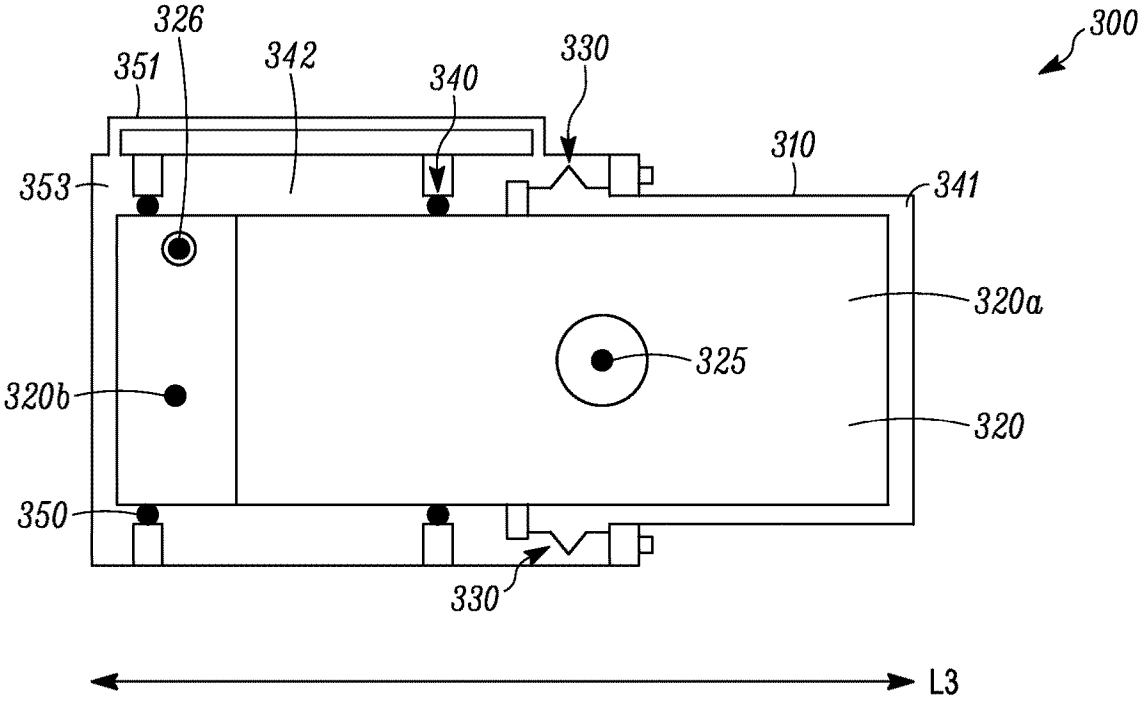
FIG. 3 illustrates a schematic diagram of a screw compressor that includes features to help reduce sound radiation and vibration transmission from a compression mechanism to an external shell, according to some embodiments.
Figure 4:
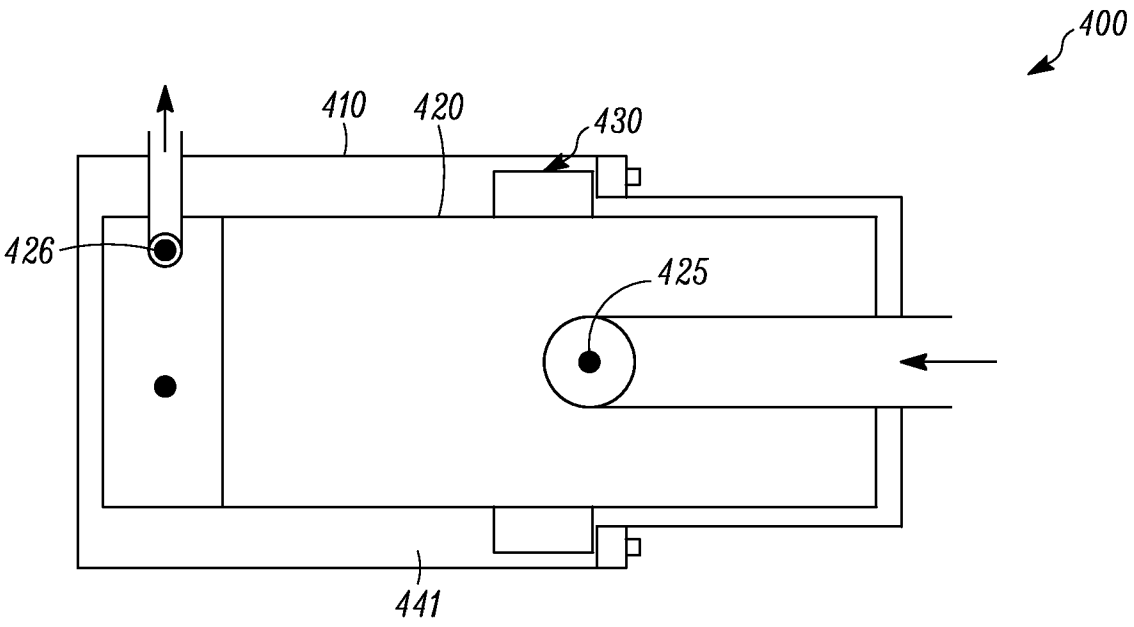
FIG. 4 illustrates a schematic diagram of a screw compressor that includes features to help reduce sound radiation and vibration transmission from a compression mechanism to an external shell, according to some embodiments.

FIGS. 2-4 illustrate that features described with respect to FIG. 1 can be applied to a screw compressor 200, 300, or 400 respectively. It is appreciated that embodiments as disclosed herein can also be applied to other types of compressors, including, for example, scroll compressors (see for example FIG. 5) or rotatory compressors.

Referring to FIG. 2, the screw compressor 200 may include an external shell 210 and a compression mechanism 220. The compression mechanism 220 may include a low-pressure side 220*a* and a high-pressure side 220*b*. The low-pressure side 220*a* is positioned in a first compartment 241 of the external shell 210 and the high-pressure side 220*b* is positioned in a second compartment 242 of the external shell 210. The first compartment 241 and the second compartment 242 are separated by a seal 240 (e.g., a pressure seal, etc.) and are generally not in fluid communication therebetween. As illustrated, the first compartment 241 can be configured to receive, for example, refrigerant in an HVAC system from an inlet 201, and the second compartment 242 can be configured to discharge, for example, compressed refrigerant in an HVAC system from the outlet 202.

The compression mechanism 220 is separated from the external shell 210 by one or more isolators 230 (e.g., shown as springs). The isolators 230 can also be configured to support a weight of the compression mechanism 220. Because the compression mechanism 220 and the external shell 210 do not contact directly, transmission of vibration from the compression mechanism 220 to the external shell 210 can be reduced or prevented. In some embodiments, the isolators 230 can be relatively resilient so as to reduce/prevent vibration transmission to the external shell 210 from the compression mechanism 220, and may also be relatively rigid to help support the weight of the compression mechanism 220. In some embodiments, when a plurality of isolators 230 is used, each of the isolators can be configured differently or about the same.

In some embodiments, the low-pressure side 220*a* can include a suction port 225. The high-pressure side 220*b* can include a discharge port 226. The high-pressure side 220*b* can also include a muffler 260, which can be positioned at a discharge end 222 of the compression mechanism 220 and enclosed by the external shell 210. One example of a muffler can be found in U.S. Pat. No. 8,016,071.

In some embodiments, a suction muffler (not shown) can be included at the suction port 225 to help reduce operational sound.

The external shell 210 may also include a third compartment 253 that is sealed by a second seal 250. In the illustrated embodiment of FIG. 2, the third compartment 253 is positioned next to the first compartment 241 and can contain a suction end 221 of the compression mechanism 220. The second seal 250 provides a seal between the third compartment 253 and the first compartment 241. The second seal 250 generally can prevent fluid communication between the third compartment 253 and the first compartment 241. In a longitudinal direction L2, the third compartment 253 is positioned opposite relative to the second compartment 242 on the compressor 200. A pressure-balancing line 251 extends between the second compartment 242 and the third compartment 253 to help balance the pressure in the second and third compartments 242, 253.

In the screw compressor 200, the compression mechanism 220 may typically include one or more screws (not shown). The screws can extend between the suction port 225 and the discharge port 226 in the longitudinal direction L2. (Not shown in FIG. 2, but see FIG. 5 for one example of a screw compressor configuration).

In operation, a fluid (e.g., refrigerant, etc.) with a relatively low pressure can be directed into the first compartment 241 of the external shell 210 via the inlet 201. The fluid can enter the compression mechanism 220 from the suction port 225, which is in fluid communication with the first compartment 241, compress the fluid, and discharge the fluid with a relatively high pressure from the discharge port 226 that is in fluid communication with the second compartment 242. The muffler 260 positioned at a discharge end 222 of the compression mechanism 220 can help absorb a portion of the vibration (e.g., discharge fluid pulsations) from the compression mechanism 220, reducing vibration transmitted to the external shell 210. The fluid with the relatively high pressure can be directed out of the compressor 200 through the outlet 202.

In the illustrated embodiment of FIG. 2, the second compartment 242 has a relatively high pressure, because the second compartment 242 has fluid communication with the high-pressure side 220*b* of the compression mechanism 220. The pressure of the second compartment 242 can be balanced with the third compartment 253 by the pressure-balancing line 251, so that both the second and third compartments 242, 253 have relatively high pressure. Therefore, a physical shift in position of the compression mechanism 220 in the longitudinal direction L2 can be reduced or eliminated.

It is noted that in the illustrated embodiment, the inlet 201 and/or the outlet 202 can be opened to a direction that is different from the suction port 225 and/or the discharge port 226 relative to the longitudinal direction L2, so that a fluid communication path between the inlet 201 and the suction port 225 or between the discharge port 226 and the outlet 202 may not be a straight path, which can help also reduce vibration transmission between the compression mechanism 222 and the external shell 210.

Referring to FIG. 3, the compressor 300 includes an external shell 310 and the compression mechanism 320, which is separated from the external shell 310 by one or more isolators 330. In the longitudinal direction L3, a seal 340 helps define a first compartment 341 and a second compartment 342 in the external shell 342. The first compartment 341 contains a low-pressure side 320*a* and a suction port 325 of the compression mechanism 320, and the second compartment 342 contains a high-pressure side 320*b* and a discharge port 326 of the compression mechanism 330.

In some embodiments, a second seal 350 helps define a third compartment 353 in the external shell 310. The third compartment 353 in some embodiments is positioned next to the second compartment 342 and is generally opposite of the first compartment 341 in the longitudinal direction L3. A pressure-balancing line 351 forms fluid communication between the first compartment 341 and the third compartment 353. In the embodiment as illustrated in FIG. 3, compared to the embodiment of FIG. 2, the third compartment 353 has a relatively lower pressure.

Referring to FIG. 4, the compressor 400 includes a compression mechanism 420 and an external shell 410. The compression mechanism 420 is isolated from the external shell 410 with, for example, a flange 430 to separate the compression mechanism 420 from the shell 410. In the embodiment of FIG. 4, a suction port 425 and a discharge port 426 are connected to refrigerant lines (not shown) directly and generally do not form fluid communication with an internal space 441 of the external shell 410. The external shell 410 does not include a plurality of spaces with different pressures and a seal may not be necessary in this embodiment. The external shell 410 may provide a layer of preventing sound radiated from the compression mechanism 420. It is to be noted that the embodiment of FIG. 4 may be used together with an existing compressor, such as a compressor with a compression mechanism positioned in a compressor housing (not shown). The embodiment of FIG. 4 can also be used to retrofit, for example, an existing HVAC system.

Figure 5:
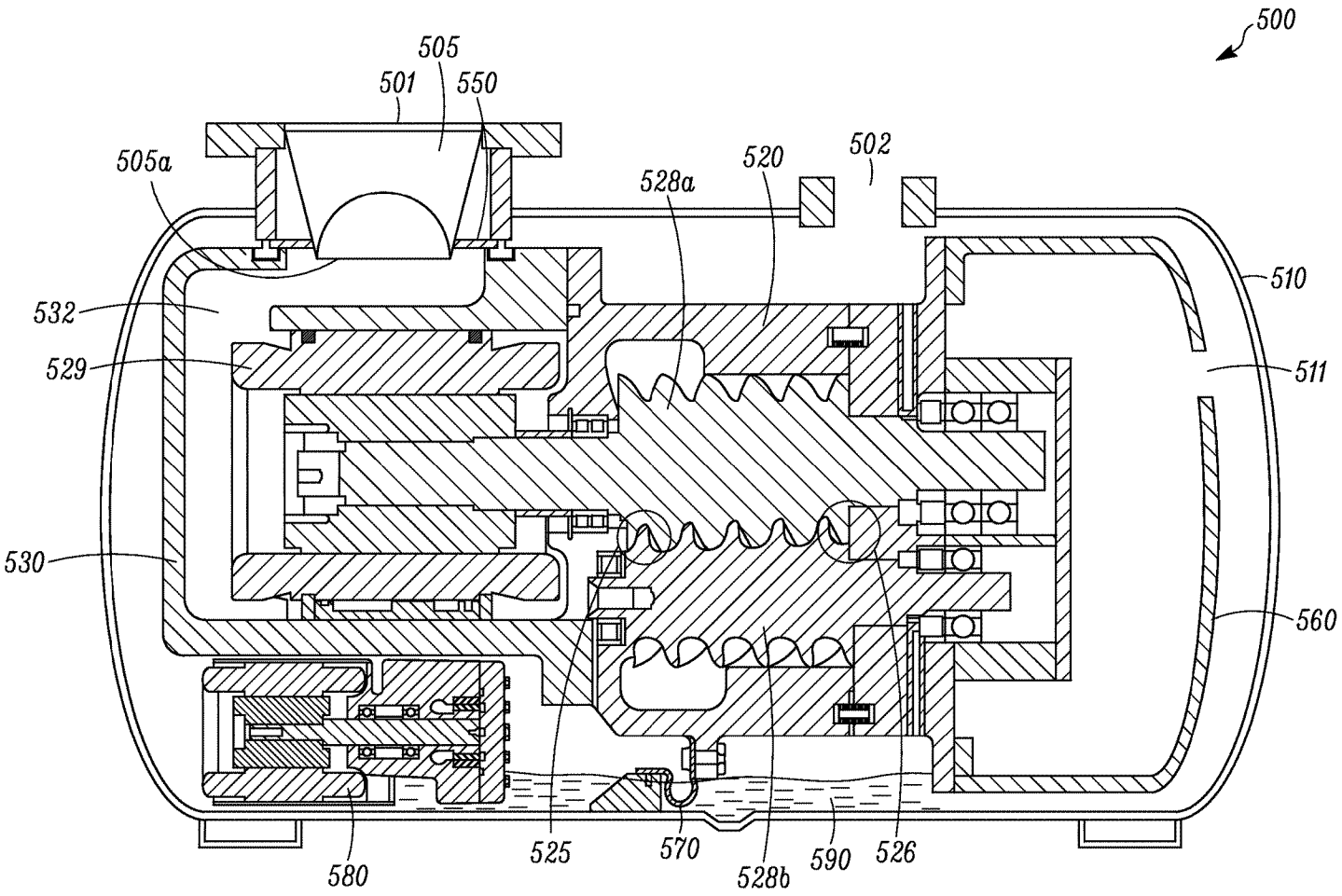
FIG. 5 illustrates a screw compressor that includes features to help reduce sound radiation and vibration transmission from a compression mechanism to an external shell, according to some embodiments.
Figure 6:
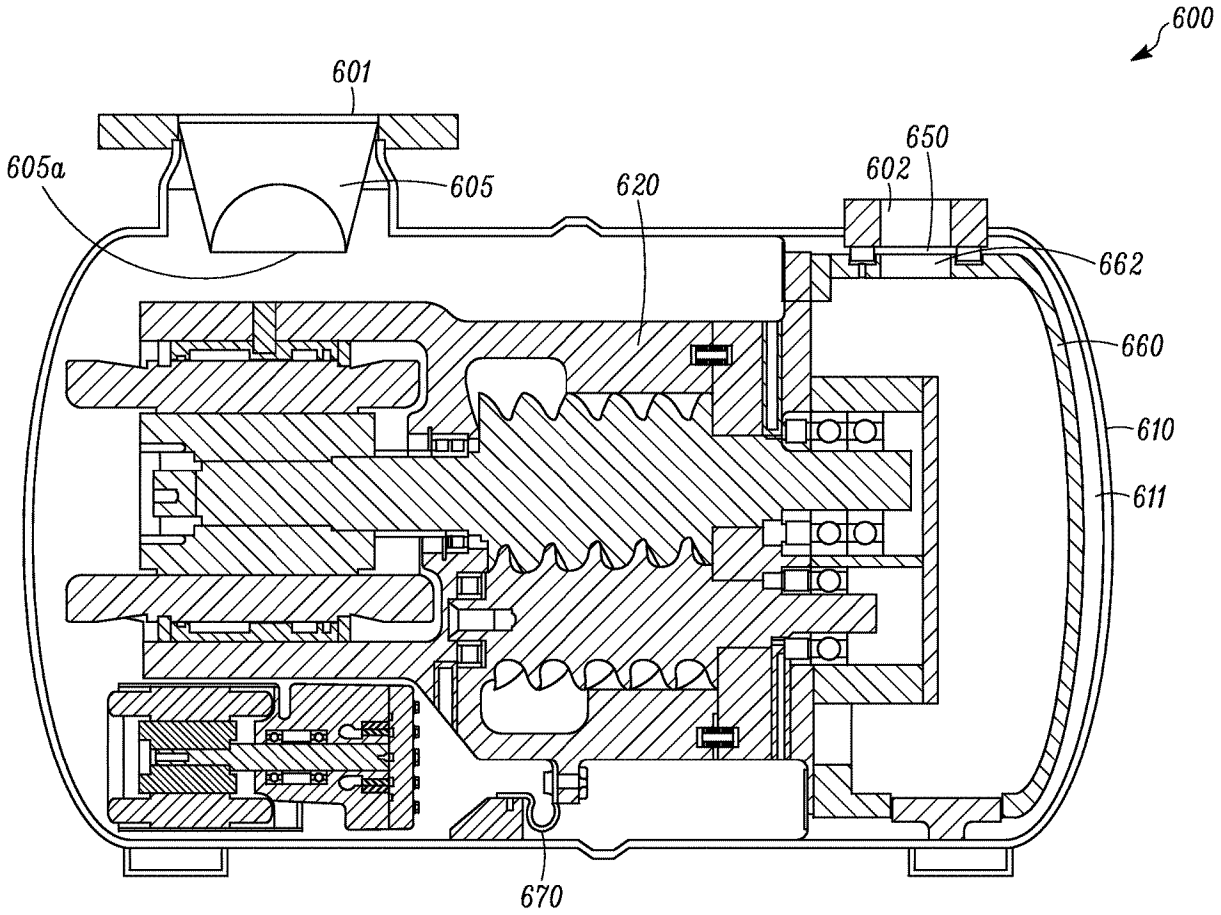
FIG. 6 illustrates a screw compressor that includes features to help reduce sound radiation and vibration transmission from a compression mechanism to an external shell, according to some embodiments.

FIGS. 5 and 6 illustrate two embodiments of a screw compressor 500, 600 respectively, which incorporate features to reduce transmission of vibration from the screw compressors 500, 600.

Referring to FIG. 5, the screw compressor 500 includes an external shell 510 and a compression mechanism 520. In the orientation as shown, the compression mechanism 520 includes first and second screws 528*a*, 528*b* positioned in a horizontal orientation. A motor 529 is configured to drive the first screw 528*a*. In operation, the motor 529 can drive the first and second screws 528*a*, 528*b* to compress a fluid. The fluid can enter into a suction port 525 of the compression mechanism 520, be compressed by the screws 528*a*, 528*b*, and discharged from a discharge port 526. In the illustrated embodiment, the discharge port 526 can direct the compressed fluid into a muffler 560. The compressed fluid can be discharged through the muffler 560 into a space 511 defined between the external shell 510 and the compression mechanism 520. The space 511 has a relatively high pressure in operation. The compressed fluid can be discharged from the screw compressor 500 through a discharge port 502. In the illustrated embodiment, the discharge port 502 and the muffler 560 do not form a direct fluid communication. The compressed fluid discharged by the muffler 560 may need to make turn(s) when the compressed fluid is directed to the outlet 502.

The motor 529 and the suction port 525 are enclosed inside a low side housing 530 that is positioned internally with respect to the external shell 510. The low side housing 530 defines a low side space 532 that is configured to receive an uncompressed fluid and has a relatively low pressure. The uncompressed fluid can enter the suction port 525 in the low side space 532.

The low side space 532 forms fluid communication with an inlet 501 through a suction screen 505. The suction screen 505 has an opening 505*a* that is internal to the low side housing 530. The low side housing 530 and the space 511 are separated by a seal 550.

Figure 8B:
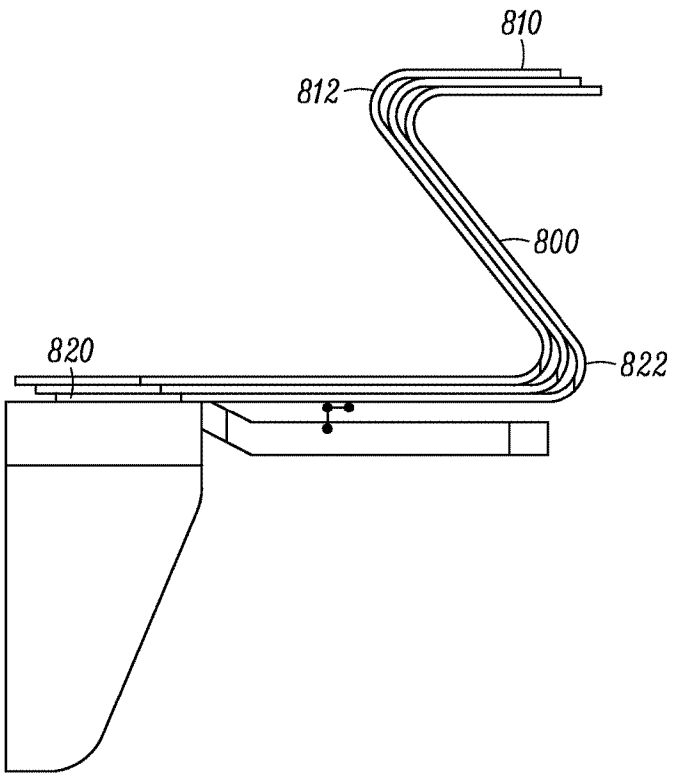
FIGS. 8A-8B illustrate an isolator that can be used to help isolate vibration from a compression mechanism to an external shell, according to some embodiments.
Figure 8A:
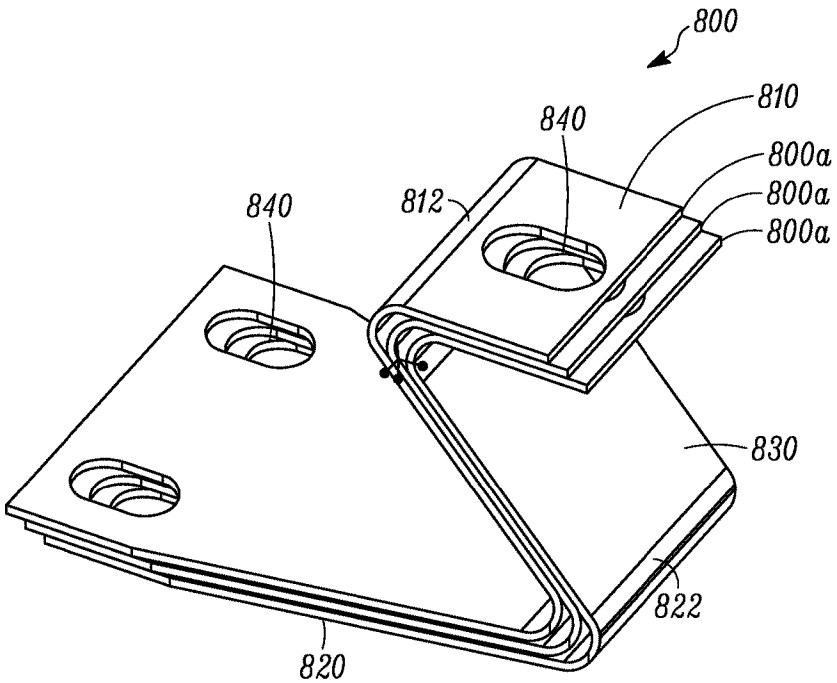

The compression mechanism 520 is separated from the external shell 510 via a resilient member 570 (e.g., a spring, etc.). The resilient member 570 can be configured to help support a weight of the compression mechanism 520. One exemplary resilient member is illustrated in FIGS. 8A and 8B.

In the illustrated embodiment of FIG. 5, an oil pump 580 can be positioned internal to the external shell 510. The oil pump 580 can be configured to pump, for example, lubricating oil to the compression mechanism 520. It is to be noted that in some embodiments, an oil pump can be positioned external to the external shell 510.

It is noted that the oil pump 580 may not be required or present in some embodiments. For example, when the space 511 of the external shell 510 has a relatively high pressure as illustrated, the oil pump 580 may be not positioned inside the external shell 510. As shown in FIG. 5, for example, in some embodiments, a space 590 toward a lower portion of the external shell 510 may be used as an oil sump to store oil. In some embodiments, when the oil pump 580 is not present in the external shell 510, the space 590 can help provide oil to the compression mechanism 520.

In the orientation of FIG. 5, the screw compressor 500 is positioned so that the screws 528*a*, 528*b* generally extend in a horizontal orientation. This is exemplary. It is appreciated that the screw compressor 500 can also be positioned so that the screws 528*a*, 528*b* can extend in other orientations, e.g., a vertical orientation, etc.

Referring to FIG. 6, the screw compressor 600 can include an external shell 610 and a compression mechanism 620 that are separated by a resilient member 670 (e.g., a spring, etc.). This feature is similar to the screw compressor 500 illustrated in FIG. 5.

A muffler 660 is configured to receive a compressed fluid. A discharge port 662 of the muffler 660 can form direct fluid communication with an outlet 602 of the screw compressor 600. That is, a compressed fluid can be directed from the discharge port 662 to the outlet 602 without making a turn. The compressed fluid can be discharged out of the screw compressor 600 from the outlet 602. The fluid communication between the muffler 660 and the outlet 602, which has a relatively high pressure in operation, is separated from a space 611 defined between the external shell 610 and the compression mechanism 620.

The space 611 forms fluid communication with an inlet 601 via a suction screen 605, which may be configured to receive an uncompressed fluid in operation. The suction screen 605 has an opening 605*a* that is positioned internally relative to the external shell 610. The space 611 has a relatively low pressure in operation and the external shell 610 can be configured to be relatively thin compared to an external shell that may be required to withstand a relatively high pressure (e.g., the external shell 510 in FIG. 5). A seal 650 can help separate the space 611 with the relatively low pressure and the outlet 602 with the relatively high pressure.

Figure 7:
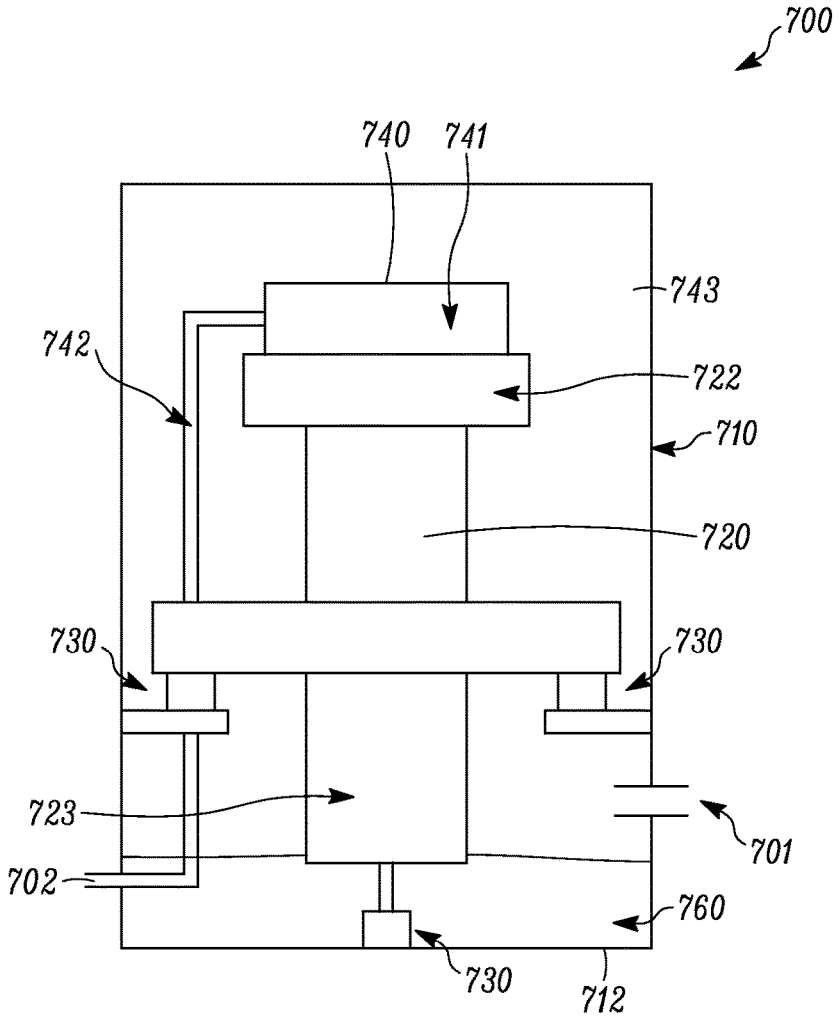
FIG. 7 illustrates a schematic diagram of a scroll compressor that includes features to help reduce sound radiation and vibration transmission from a compression mechanism to an external shell, according to some embodiments.

FIG. 7 illustrates a scroll compressor 700 that includes features to help reduce transmission of vibration and operational sound. The scroll compressor 700 includes an external shell 710 and a compression mechanism 720. The external shell 710 is configured to enclose the compression mechanism 720.

The compression mechanism 720 includes one or more scrolls 722 that can be driven by a motor 723. The compression mechanism 720 can be separated from the external shell 710 by one or more isolators 730. In the scroll compressor 700, the isolators 730 can help support a weight of a compression mechanism 720. The isolators 730 can help reduce or prevent vibration of the compression mechanism 720 from being transmitted to the external shell 710 in operation.

A discharge cap 740 is positioned on a discharge side of the compression mechanism 720 and helps define a discharge plenum 741 that can receive a fluid compressed by the scroll 722 in operation. The discharge plenum 741 forms fluid communication with an outlet 702 of the scroll compressor 700 through a discharge line 742. Generally, in operation, the discharge plenum 741, the discharge line 742 and the outlet 702 may carry the compressed fluid with a relatively high pressure and do not typically have fluid communication with a space 743 that is between the discharge plenum 741 and the external shell 710. The space 743 can form fluid communication with an inlet 701 of the scroll compressor 700. In operation, the space 743 generally carries an uncompressed fluid with a relatively low pressure. In the embodiment of FIG. 7, the discharge cap 740 can provide a separation between a high-pressure side and a low-pressure side of the scroll compressor 700.

It is to be noted that in some embodiments, the discharge line 742 may be configured to be relatively soft and relatively dynamic to help reduce/prevent vibration transmission via the discharge line 742 from the compression mechanism 720 to the external shell 710.

In the embodiment of FIG. 7, the scrolls 722 are oriented on a top of the motor 723 in a vertical orientation relative to the orientations of FIG. 7. The space 743 can contain, for example, a mixture of refrigerant (not shown) and lubricating oil 760. Due to, for example, gravity, the lubricating oil 760 may accumulate toward a bottom 712 of the external shell 710, which can help separate the lubricating oil 760 and the refrigerant. It is to be appreciated that the oil separation feature(s) of this embodiment may also be incorporated in other embodiments as described herein. In an HVAC system, for example, an oil separator may be a source of operational sound. Incorporating the oil separation feature(s) into the external shell 710 can help eliminate an external oil separator, which may help reduce the operational sound.

FIGS. 8A and 8B illustrate a resilient member 800 (e.g., a spring) that can be used to isolate a compression mechanism (e.g., the compression mechanism 520 in FIG. 5) and an external shell (e.g., the external shell 510 in FIG. 5). In some embodiments, the resilient member 800 is configured to be relatively resilient so that vibration of the compression mechanism can be isolated from the external shell. That is, the resilient member 800 can help reduce vibration transmission between the compression mechanism and the external shell. The resilient member 800 can also be configured to be relatively rigid so that the resilient member 800 can help support a weight of the compression mechanism.

In some embodiments, the resilient member 800 can include one or more "Z" shaped pieces 800*a*. For example, one or more of the resilient member pieces 800*a* can have a first arm 810 and a second arm 820 connected by a stem 830. In some embodiments, the first arm 810 can be configured to be coupled to the compression mechanism (e.g., the compression mechanism 520 in FIG. 5), and the second arm 820 can be configured to be coupled to the external shell (e.g., the external shell 510 in FIG. 5). A first curved portion 812 is situated between the first arm 810 and the stem 830, and a second curved portion 822 is situated between the stem 830 and the second arm 820. The first and second curved portions 812, 822 can be configured to be relatively resilient. In the orientation shown in FIG. 8B, the resilient member 800 can be relatively resilient in multiple directions, which can help isolate vibration from the first arm 801 and the second arm 820. The first and second curved portions 812, 822 can also be relatively supportive, for example, in the vertical orientation, to support, for example, a weight of the compression mechanism. The first and second arms 810, 820 can have one or more mounting openings 840, which can receive a mounting mechanism (e.g., a screw) to mount the resilient member 800 to a compression mechanism (e.g., the compression mechanism 120) and/or a shell (e.g., the shell 110).

The resilient member 800 can be made of, for example, a sheet metal, plastic, composite material, or other suitable materials. In some embodiments, a plurality of similarly configured sheet metal pieces can be used (e.g., stacked, etc.) to form the resilient member 800.

It is to be appreciated that the external shell can include one or more sections. The section(s) that needs to bear a relatively low pressure (e.g., the section of the external shell 210 that encloses the space 241) can be, for example, made of a relatively thin material. The section(s) that needs to bear a relatively high pressure (e.g., the section of the external shell 210 that encloses the space 241) can be, for example, made of a relative thick material. The different sections can be, for example, joined by bolts.

It is to be appreciated that the embodiments as disclosed here can be used generally with a compressor, such as for example a refrigerant compressor, a liquid pump, or an air compressor.

It is to be appreciated that the features as described herein can be combined with other configurations that may help isolate and/or absorb vibration of the compression mechanism. The features described herein can also be optional. Some embodiments may include some of, but not all of the features as described herein.

Aspects

Any one of aspects 1 to 11 can be combined with any one of aspects 12 to 14.

Aspect 1. A compressor, comprising:

a compression mechanism, the compression mechanism having a first pressure side and a second pressure side;

an external shell, the external shell configured to enclose the compression mechanism;

wherein the compression mechanism is isolated from the external shell by an isolator.

Aspect 2. The compressor of aspect 1, wherein the external shell is configured to include a first compartment and a second compartment, and the first compartment is in fluid communication with the first pressure side and the second compartment is in fluid communication with the second pressure side.

Aspect 3. The compressor of aspect 2, wherein the external shell includes a third compartment, the third compartment encloses a first portion of the compression mechanism, the second compartment encloses a second portion of the compression mechanism, the first portion and the second portion of the compressor are oppositely located, and a pressure in the first compartment and a pressure in the third compartment are balanced.

Aspect 4. The compressor of any one of aspects 1-3, wherein the first pressure side includes a suction port of the compression mechanism, and the second pressure side includes a discharge port of the compression mechanism.

Aspect 5. The compressor of aspect 4, wherein the external shell includes an outlet, and the outlet and the discharge port form fluid communication with the first compartment.

Aspect 6. The compressor of any one of aspects 4-5, wherein the external shell includes an inlet, and the inlet and the suction port form fluid communication with the second compartment.

Aspect 7. The compressor of any one of aspects 4-6, wherein the discharge port is equipped with a muffler.

Aspect 8. The compressor of any one of aspects 3-7, further including:

a pressure balancing line connecting the first compartment and the third compartment.

Aspect 9. The compressor of any one of aspects 1-8, wherein the compression mechanism is a screw-type compressor.

Aspect 10. The compressor of any one of aspects 1-9, wherein the compression mechanism is a scroll-type compressor.

Aspect 11. The compressor of any one of aspects 1-10, wherein a weight of the compression mechanism is supported by the isolator.

Aspect 12. A method of reducing operational sound of a compressor, comprising:

enclosing a compression mechanism of the compressor in a shell;

partitioning the shell to include a first compartment and a second compartment;

positioning a low-pressure side of the compression mechanism in the first compartment and a high-pressure side of the compression mechanism in the second compartment; and isolating the compression mechanism from the shell.

Aspect 13. The method of aspect 12, further comprising:

partitioning the shell to include a third compartment, wherein a third portion of the compression mechanism is positioned in the third compartment; and balancing a pressure in the first compartment and the third compartment when the compression mechanism is in operation.

Aspect 14. The method of any one of aspects 12-13, further comprising:

partitioning the shell to include a third compartment, wherein a third portion of the compression mechanism is positioned in the third compartment; and balancing a pressure in the first compartment and the second compartment when the compression mechanism is in operation.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed, and the shape, size, and arrangement of parts, without departing from the scope of the present disclosure. The word "embodiment," as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

What is claimed is:

1. A screw compressor, comprising:

a screw compression mechanism, the screw compression mechanism having a first pressure side and a second pressure side;

an external shell, the external shell configured to enclose the screw compression mechanism, and the external shell including a first compartment, a second compartment, and a third compartment, the first compartment being in fluid communication with the first pressure side, the second compartment being in fluid communication with the second pressure side, the third compartment encloses a first portion of the screw compression mechanism, the second compartment encloses a second portion of the screw compression mechanism, the first portion and the second portion of the screw compression mechanism are oppositely located, and a pressure in the second compartment and a pressure in the third compartment are balanced;

a first seal fluidly separating the first compartment and the second compartment; and a second seal fluidly separating the first compartment and the third compartment, the second seal secured to the external shell and the second seal secured to the screw compression mechanism, thereby forming the third compartment, wherein the screw compression mechanism is isolated from the external shell by an isolator secured to the external shell and to the screw compression mechanism, wherein the isolator is configured to reduce vibration transmitted from the screw compression mechanism to the external shell, and wherein the first seal is physically separate from the isolator.

2. The screw compressor according to claim 1, wherein the first pressure side includes a suction port of the screw compression mechanism, and the second pressure side includes a discharge port of the screw compression mechanism.

3. The screw compressor according to claim 2, wherein the external shell includes an outlet, and the outlet and the discharge port form fluid communication with the second compartment.

4. The screw compressor according to claim 2, wherein the external shell includes an inlet, and the inlet and the suction port form fluid communication with the first compartment.

5. The screw compressor according to claim 2, wherein the discharge port is equipped with a muffler.

6. The screw compressor according to claim 1, further including:

a pressure balancing line connecting the second compartment and the third compartment.

7. The screw compressor according to claim 1, wherein a weight of the screw compression mechanism is supported by the isolator.

8. The screw compressor according to claim 1, wherein the first pressure side includes a suction port of the screw compression mechanism, and the second pressure side includes a discharge port of the screw compression mechanism, the third compartment being disposed opposite the second compartment so that the first compartment is arranged between the second compartment and the third compartment.

9. A method of reducing operational sound of a screw compressor, comprising:

enclosing a screw compression mechanism of the screw compressor in a shell;

partitioning the shell to include a first compartment and a second compartment;

positioning a low-pressure side of the screw compression mechanism in the first compartment and a high-pressure side of the screw compression mechanism in the second compartment;

sealing the low-pressure side of the screw compression mechanism in the first compartment from the high-pressure side of the screw compression mechanism in the second compartment with a first seal;

isolating the screw compression mechanism from the shell to reduce a vibration transmitted from the screw compression mechanism to the shell, the isolating including securing an isolator to the screw compression mechanism and to the shell, the isolator being physically separate from the first seal;

partitioning the shell to include a third compartment using a second seal, the partitioning including securing the second seal to the screw compression mechanism and securing the second seal to the shell, wherein the third compartment encloses a first portion of the screw compression mechanism and the second compartment encloses a second portion of the screw compression mechanism;

and balancing a pressure in the second compartment and the third compartment when the screw compression mechanism is in operation.

10. The method according to claim 9, wherein the first compartment is disposed between the second compartment and the third compartment of the screw compression mechanism.

* * * * *